US011325335B2

(12) United States Patent
Johnson et al.

(10) Patent No.: US 11,325,335 B2
(45) Date of Patent: May 10, 2022

(54) PRESSING ORIENTED PELLETS IN A MAGNETIC FIELD

(71) Applicant: The Government of the United States of America, as represented by the Secretary of the Navy, Arlington, VA (US)

(72) Inventors: Scooter David Johnson, Hyattsville, MD (US); Jeffrey Wang Xing, Irvine, CA (US); Michael Doherty, Chantilly, VA (US)

(73) Assignee: The Government of the United States of America, as represented by the Secretarv of the Navy, Washington, DC (US)

( * ) Notice: Subject to any disclaimer, the term of this patent is extended or adjusted under 35 U.S.C. 154(b) by 539 days.

(21) Appl. No.: 16/534,283

(22) Filed: Aug. 7, 2019

(65) Prior Publication Data

US 2020/0047443 A1 Feb. 13, 2020

Related U.S. Application Data

(60) Provisional application No. 62/715,406, filed on Aug. 7, 2018.

(51) Int. Cl.
*B30B 15/30* (2006.01)
*H01F 41/02* (2006.01)
(Continued)

(52) U.S. Cl.
CPC ..... *B30B 15/304* (2013.01); *B22F 3/004* (2013.01); *B22F 3/03* (2013.01); *B30B 7/00* (2013.01);
(Continued)

(58) Field of Classification Search
CPC .. H01F 41/01; H01F 41/0266; H01F 41/0273; B22F 3/03; B22F 2003/033;
(Continued)

(56) References Cited

U.S. PATENT DOCUMENTS 3,555,621 A 1/1971 Hara
5,897,826 A * 4/1999 Lashmore ..... B30B 15/302 425/258

(Continued)

FOREIGN PATENT DOCUMENTS

JP 29-2017024076 A 2/2017

OTHER PUBLICATIONS

Search Report and Written Opinion in PCT/US2019/045464 (dated Nov. 29, 2019).

(Continued)

*Primary Examiner* — Philip C Tucker
*Assistant Examiner* — Jimmy R Smith, Jr.
(74) *Attorney, Agent, or Firm* — US Naval Research Laboratory; Joseph Grunkemeyer

(57) ABSTRACT

Disclosed herein is a method and apparatus for forming pellets in a non-ambient environment such as a strong magnetic field. The apparatus includes a die body, a die bottom, a short push pin, a long push pin, a press tube, and an extended push pin. A powder is loaded into the die body, which is then positioned in the non-ambient environment, and the powder allowed to equilibrate. A pellet is then formed by pressing on the extended push pin while the powder is in the non-ambient environment.

9 Claims, 13 Drawing Sheets

(51) Int. Cl.
*B22F 3/00* (2021.01)
*B22F 3/03* (2006.01)
*B30B 7/00* (2006.01)

(52) U.S. Cl.
CPC .... *H01F 41/0266* (2013.01); *B22F 2003/033* (2013.01); *B22F 2999/00* (2013.01)

(58) Field of Classification Search
CPC .. B30B 1/32; B30B 7/00; B30B 15/06; B30B 15/065; B30B 15/304; B30B 15/02; B30B 15/022
See application file for complete search history.

(56) References Cited

U.S. PATENT DOCUMENTS 6,497,157 B1 12/2002 Viegas et al.
6,969,244 B2 11/2005 Kuniyoshi et al.
2005/0183792 A1 8/2005 Chou et al.
2011/0311667 A1* 12/2011 Bayle ..... B30B 15/022 425/193
2012/0276237 A1 11/2012 Heymanns et al.
2013/0313741 A1 11/2013 Menzel et al.
2016/0121290 A1 5/2016 Sidhu

OTHER PUBLICATIONS

Chen et al., "Low-loss barium ferrite quasi-single-crystals for microwave application", J. Appl. Phys. 101, 09M501 (2007).
Johnson et al., "Design and Implementation of a Magnetic Press System for Creating Magnetically Oriented Barium Hexaferrite Pucks" IEEE Trans. Magnetics, 55, 2801406, Jul. 2019.
Mattei et al., "A simple process to obtain anisotropic self-biased magnets constituted of stacked barium ferrite single domain particles", J. Magn. and Magn. Mat., 451, 208 (2018).
Wang et al., "Enhanced efficiency C-axis textured M-type barium ferrite for realization of self-biased circulators", J. Mat. Sci.: Mat. in Electronics, 29, 10311 (2018).

* cited by examiner

PRESSING ORIENTED PELLETS IN A MAGNETIC FIELD

This application claims the benefit of U.S. Provisional Application No. 62/715,406, filed on Aug. 7, 2018. The provisional application and all other publications and patent documents referred to throughout this nonprovisional application are incorporated herein by reference.

TECHNICAL FIELD

The present disclosure is generally related to pellet presses.

DESCRIPTION OF RELATED ART

Barium hexaferrite ($BaFe_{12}O_{19}$, BaM) is an important material for microwave circuitry and a potential candidate material for reducing core loss in non-rare-earth-based high frequency motors (Simizu et al., "Metal amorphous nanocomposite soft magnetic material-enabled high power density, rare earth free rotational machines" *IEEE Trans. Magn.,* 54(5), 1-5 (2018)) due to its high magnetic anisotropy $H_a$=1352 kA/m (17 kOe), large magnetic saturation 4π Ms=4.8 kG (72 emu/g), and large theoretical coercivity of $H_c$=594 kA/m (7.5 kOe), but due to its high melting temperature of 1611° C. integration into standard CMOS processing remains a challenge (Harris et al., "Recent advances in processing and applications of microwave ferrites" *J. Magn. Magn. Mat.,* 321(14), 2035-2047 (2009); Pullar, "Hexagonal ferrites: A review of the synthesis, properties and applications of hexaferrite ceramics" *Prog. Mater. Sci.,* 57(7), 1191-1334 (2012)).

For these applications, it is desirable to produce a thick magnetically oriented material to improve loss, squareness, and eliminate biasing magnets. There have been several studies focused on creating magnetically oriented BaM with the magnetic easy axis oriented out of plane (OOP).

Pulsed laser deposition has been carried out to successfully grow highly oriented BaM on MgO/SiC (Chen et al., "Epitaxial growth of M-type Ba-hexaferrite films on MgO (111)-SiC (0001) with low ferromagnetic resonance linewidths" *Appl. Phys. Lett.,* 91(18), 182505 (2007)) and $GaN/Al_2O_3$ (Ohodnicki et al., "Magnetic anisotropy and crystalline texture in $BaO(Fe_2O_3)_6$ thin films deposited on $GaN\text{-}Al_2O_3$" *J. Appl. Phys.,* 101(9), 09M521 (2007)). However, to attain thicker materials, other techniques must be employed.

Liquid-phase epitaxy has been used to produce thick single-crystal films with a good saturation magnetization of 4.4 kG and OOP orientation along the {0 0 21} planes, however, coercivity is generally very low (≤10 Oe) due to the single-crystal nature of the film (Wang et al., "Microwave and magnetic properties of double-sided hexaferrite films on (111) magnesium oxide substrates" *J. Appl. Phys.,* 92(11), 6728-6732 (2002); Chen et al., "Structure, magnetic, and microwave properties of thick Ba-hexaferrite films epitaxially grown on $GaN/Al_2O_3$ substrates" *Appl. Phys. Lett.,* 96(24), 242502 (2010)). Therefore, several efforts have involved attempting to produce high-quality quasi-single crystal materials.

Modified liquid-phase epitaxy or liquid-phase reflow technique has been used to produce 350 μm thick highly oriented quasi-single crystal BaM samples but with $H_c$=102 Oe and a diminished 4π Ms≈2 kG (Kranov et al., "Barium hexaferrite thick films made by liquid phase epitaxy reflow method" *IEEE Trans. Magn.,* 42(10), 3338-3340 (2006)).

A solid-state reaction process at temperatures of 1300° C.-1400° C. produced high-quality quasi-single crystal samples with a good saturation magnetization of about 4.48 kG and OOP orientation along the {0 0 21} planes (Chen et al., "Low-loss barium ferrite quasi-single-crystals for microwave application" *J. Appl. Phys.,* 101(9), 09M501 (2007). In all these techniques, high temperatures >800° C. were required to grow the films and the coercivity was very low $H_c$<102 Oe due to the single-crystal nature.

One route to lower temperature fabrication and larger values of coercivity is to fabricate polycrystalline samples. Along this direction, there have been several efforts to form oriented polycrystalline materials. These techniques generally involve attempting physical rotation and orientation of the BaM hexagonal platelets by forming the bulk puck in the presence of a magnetic field (Chen et al., "Oriented barium hexaferrite thick films with narrow ferromagnetic resonance linewidth" *Appl. Phys. Lett.,* 88(6), 062516 (2006)). For example, thick films of 100-500 μm, large coercivity and saturation magnetization values were achieved by using a screen printing technique in the presence of an 8 kOe biasing field. The resulting samples achieved good values of 4π Ms=4 kG and $H_c$=1935 Oe (Chen et al., "Screen printed thick self-biased, low-loss, barium hexaferrite films by hot-press sintering" *J. Appl. Phys.,* 100(4), 043907 (2006)).

A similar technique involved simply pressing the pucks after shaking the powder in the presence of a magnetic field to align the loose powder. The loosely packed and magnetically oriented powder was then pressed and sintered at 1300° C. to densify the pucks. The results produced pucks with a good saturation magnetization of 71 emu/g and texturing (Annapureddy et al., "Growth of self-textured barium hexaferrite ceramics by normal sintering process and their anisotropic magnetic properties" *J. Eur. Ceram. Soc.,* 37(15), 4701-4706 (2017)). A review of these and similar techniques can be found in a review by Harris et al.

The large size and weight of current hydraulic pellet press systems limits their use to techniques that can be mounted or modified to accommodate the press system. Current technology utilizes ex situ techniques of attempting to orient the powder using a magnetic field and the loading the material into a press system. This technique is not very effective because the particles can rearrange during the loading process into the press system. Another technique involves utilizing a commercial hydraulic press that has been modified to permit a magnetic field during pressing. While the technique can produce oriented pellets, this technique suffers from the challenge that both the hydraulic press and magnet are large, heavy objects and maneuvering the system into the proper alignment is burdensome and inflexible.

BRIEF SUMMARY

Disclosed herein is a method comprising: providing an apparatus comprising: a die body having a first cylindrical hole therethrough, a die bottom attached to the die body to cover a first opening of the first hole, a cylindrical short push pin shorter than the first hole and having the same cross-section as the first hole inserted into the first hole, a long push pin having a first cylindrical end having the same cross-section as the first hole and a second end having a smaller cross-section than the first end, an O-ring around the second end, a press tube having a second hole therethrough attachable to the die body to align the second hole with a second opening of the first hole, and an extended push pin that fits through the second hole; placing a material into the first hole; placing the first end of the long push pin into the first hole leaving a space between the material and the long push pin; attaching the press tube to the die body; placing the extended push pin in the second hole; positioning the apparatus to place the material in a non-ambient environment; allowing the material to at least partially equilibrate in the non-ambient environment; and pressing on the extended push pin to form a pellet of the material while the material is in the non-ambient environment. The combined length of the short push pin, the long push pin, and the extended push pin is longer than the combined length of the first hole and the second hole.

Also disclosed herein is an apparatus comprising: a die body having a first cylindrical hole therethrough, a die bottom attached to the die body to cover a first opening of the first hole, a cylindrical short push pin shorter than the first hole and having the same cross-section as the first hole inserted into the first hole, a long push pin having a first cylindrical end having the same cross-section as the first hole inserted into the first hole and a second end having a smaller cross-section than the first end, an O-ring around the second end, a press tube having a second hole therethrough attached to the die body to align the second hole with a second opening of the first hole, and an extended push pin inserted into the second hole. The short push pin is between the die bottom and the first end of the long push pin. The combined length of the short push pin, the long push pin, and the extended push pin is longer than the combined length of the first hole and the second hole.

BRIEF DESCRIPTION OF THE DRAWINGS

A more complete appreciation will be readily obtained by reference to the following Description of the Example Embodiments and the accompanying drawings.

DETAILED DESCRIPTION OF EXAMPLE EMBODIMENTS

In the following description, for purposes of explanation and not limitation, specific details are set forth in order to provide a thorough understanding of the present disclosure. However, it will be apparent to one skilled in the art that the present subject matter may be practiced in other embodiments that depart from these specific details. In other instances, detailed descriptions of well-known methods and devices are omitted so as to not obscure the present disclosure with unnecessary detail.

Disclosed herein is a lightweight portable press system that can be operated in confining environments, such as in the presence of a strong (greater than 1 T) magnetic field to allow the magnetic particles to align within the field before and during compression of the powder to form magnetically oriented bulk pellets. The system can be operated in a wide range of environments, including, an axial or transverse magnetic field, furnace, electric field, and can be used with applied heat, and/or filled with a liquid slurry of powder.

The apparatus may be lightweight and easily maneuverable into various magnet systems and field alignments. For the purpose of orienting the particles, the apparatus can be maneuvered into and out of the magnetic field region easily to produce field gradients that assist in particle orientation. The ease of operation opens up additional processing options and capabilities, such as heating, liquid insertion, field gradients, and electric and/or magnetic field exposure.

Figure 1:
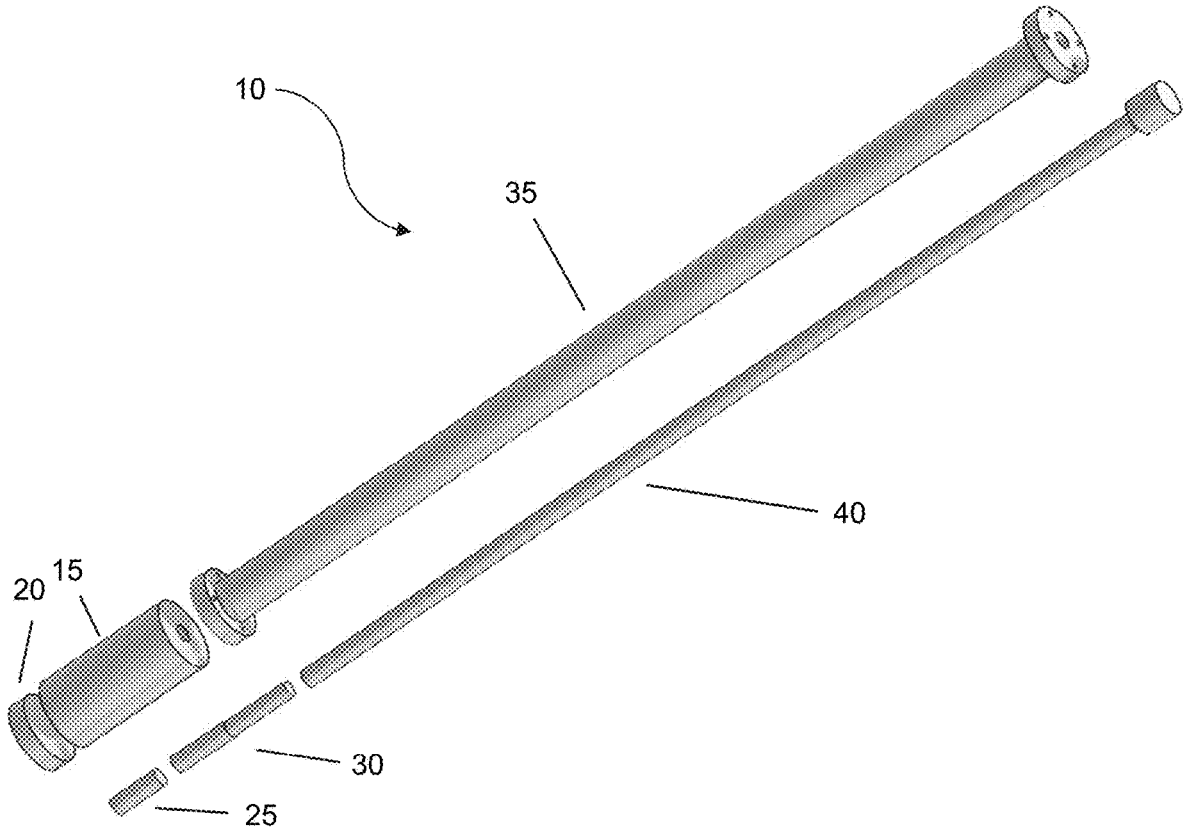
FIG. 1 schematically illustrates all the parts of an apparatus.

An example of the apparatus 10 is shown in FIG. 1. The apparatus 10 may be comprised of non-magnetic materials to reduce field distortion inside the press die. As used herein, a cylinder is any solid or space having two parallel, congruent sides (rounded, polygonal, or a combination thereof) connected by one or more faces at right angles to the parallel sides. This could be circular cylindrical, rectangular, or any other cylindrical shape or prism shape desired, or any combination of such shapes. Any cylinder described herein may vary from this definition as long as the apparatus functions as described. Any part of the apparatus 10 not specifically described as cylindrical may optionally be cylindrical.

Figure 2:
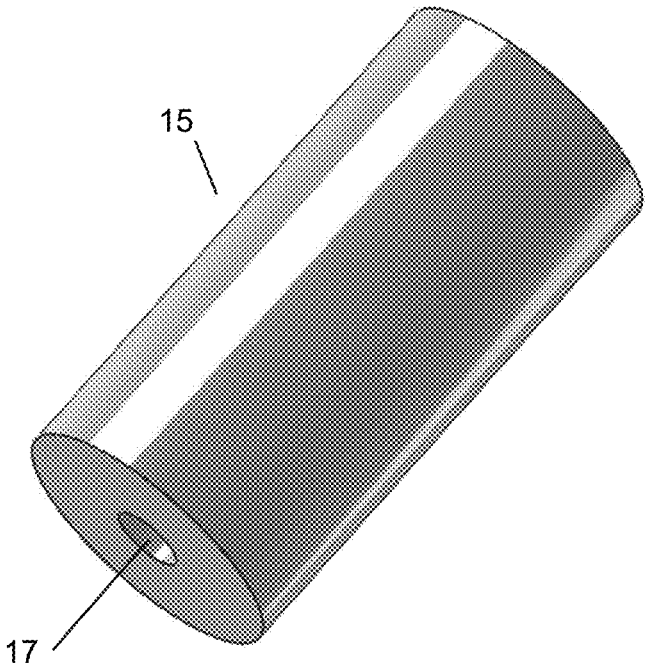
FIG. 2 schematically illustrates the die body.
Figure 3:
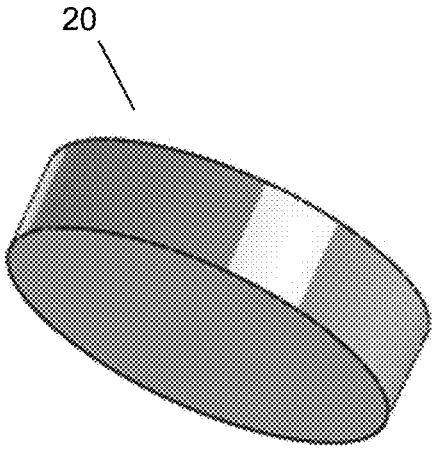
FIG. 3 schematically illustrates the die bottom.

FIG. 2 is a drawing of the die body 15 and FIG. 3 is the die bottom 20. The die body 15 is formed with a first cylindrical hole or central bore 17 that is the shape and diameter of the desired pellet to be pressed. The size of the bore 17 may be customized to the desire of the user and may be, for example, a 6 mm diameter cylindrical bore. A portion of the bore 17 may deviate from cylindrical form to make a non-cylindrical pellet as long as the portions of the bore 17 occupied by the pins during pressing is cylindrical. The die bottom 20 is attached to the die body 15 to cover a first opening of the bore 17 and to hold the material in place and provide an opposing surface during pressing.

Figure 4:
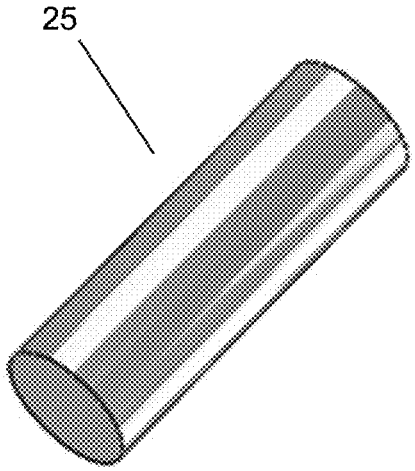
FIG. 4 schematically illustrates the short push pin.
Figure 5:
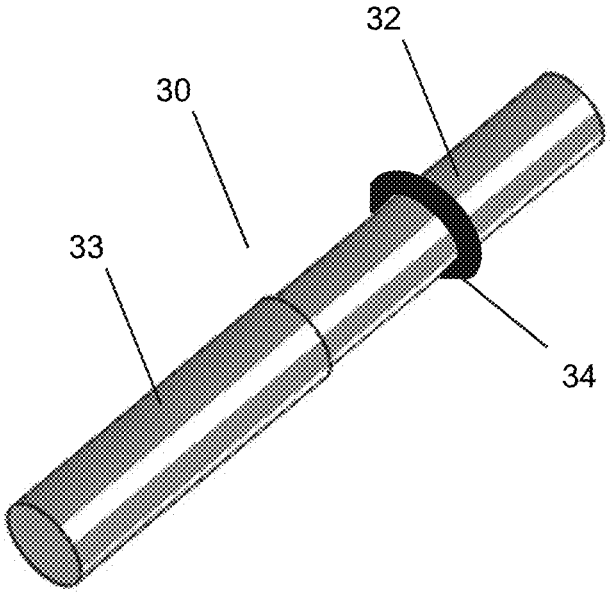
FIG. 5 schematically illustrates the long push pin.

FIGS. 4 and 5 show the push pins that contact the material. The lower or short cylindrical push pin 25 is shorter than the bore 17 and has the same cross-section as the bore 17. The short push pin 25 is inserted into the die body 17 and rests on the die body bottom 20. Powder is then inserted into the die body cavity 17 and the upper or long push pin 30 is inserted. The long push pin 30 features a reduced diameter portion 32 to facilitate ease of pressing. The other end 33 is cylindrical and has the same cross-section as the bore 17. (The push pins 25, 30 may have a slightly smaller cross-section that the bore 17 so that they may slide within the bore 17, as long as they are not so much small as to allow the powder to be squeezed between the pin 25, 30 and the bore 17.) A rubber O-ring 34 is placed around the reduced diameter section 32 of the long press pin 30 to hold it away from the powder during the particle orientation process. This ensures that the powder can freely rotate and move around inside the press cavity 17.

Figure 6:
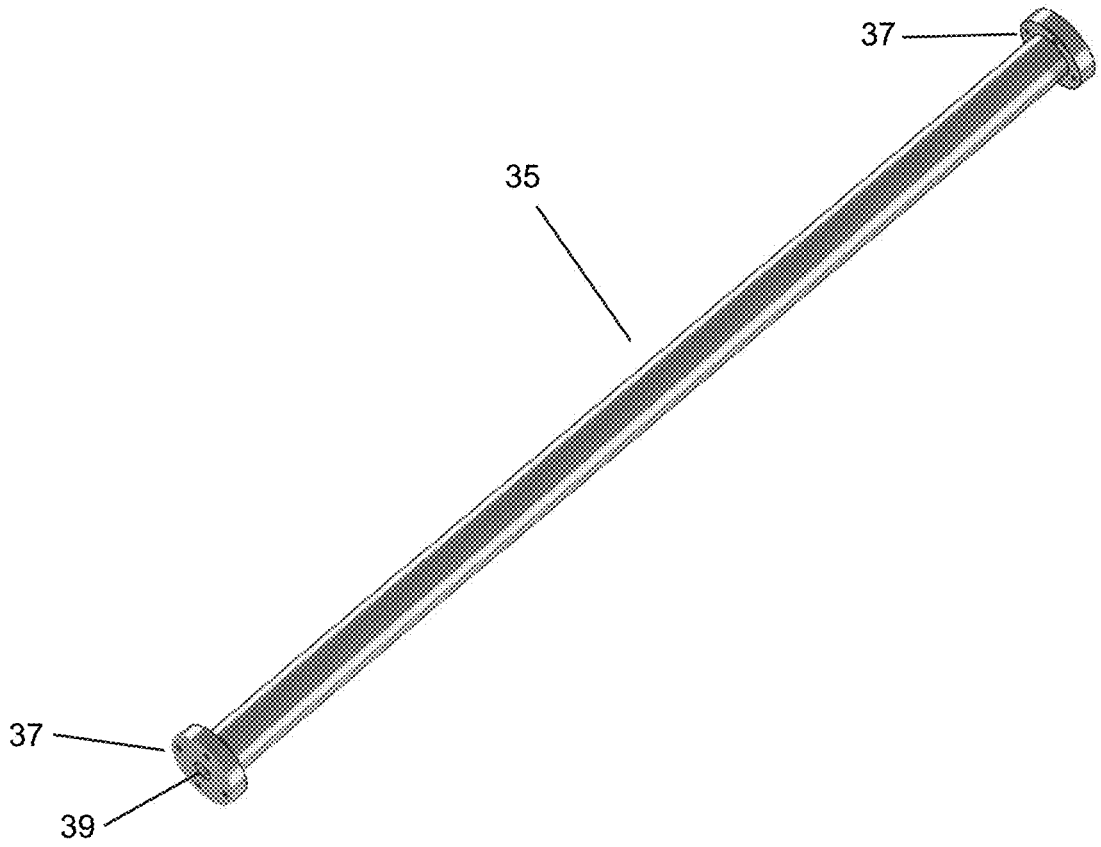
FIG. 6 schematically illustrates the press tube.
Figure 7:
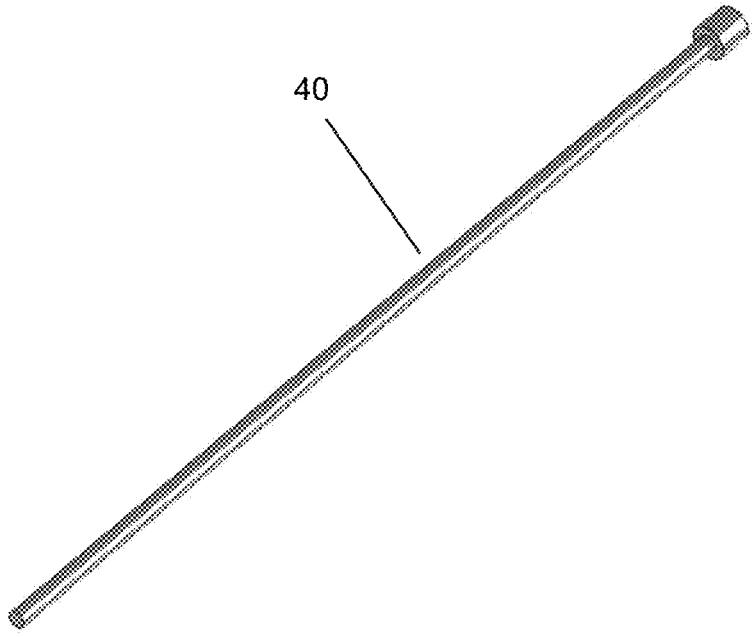
FIG. 7 schematically illustrates the extended push pin

The assembled die is attached to the press tube 35 shown in FIG. 6. FIG. 6 shows the press tube 35 in a "cut-away" view. The press tube 35 contains guide holes 37 at either end to guide the extended press pin 40 (FIG. 8) from the top of the tube to the bottom where it contacts the long press pin 30. The press tube 35 also has a second hole 39 therethrough that aligns with the bore 17 when attached to the die body 20. The second hole 39 need not be cylindrical or identical to the bore 17 as long as it allowed the extended push pin 40 to pass through. The combined length of the short push pin 25, the long push pin 30, and the extended push pin 40 is longer than the combined length of the first hole 17 and the second hole 39. The purpose of the press tube 40 is to provide a support shaft that can be mounted into a support frame to hold the press system 10 in place and to provide ample distance from the strong magnetic field region to the loading mechanism.

The apparatus is assembled 10 by inserting the short push pin 25 into the first hole 17, placing a material into the first hole 17, placing the first end 33 of the long push pin 30 into the first hole 17 leaving a space between the material and the long push pin 30, attaching the press tube 35 to the die body 15, and placing the extended push pin 40 in the second hole 39. These steps may be performed in any sequence that results in correct assembly. The apparatus 10 is then positioned to place the material in a non-ambient environment. The non-ambient environment may have any properties that vary from standard indoor conditions, including but not limited to, a magnetic field, a vacuum, an elevated temperature, an electric field, or any combination thereof.

Figure 8:
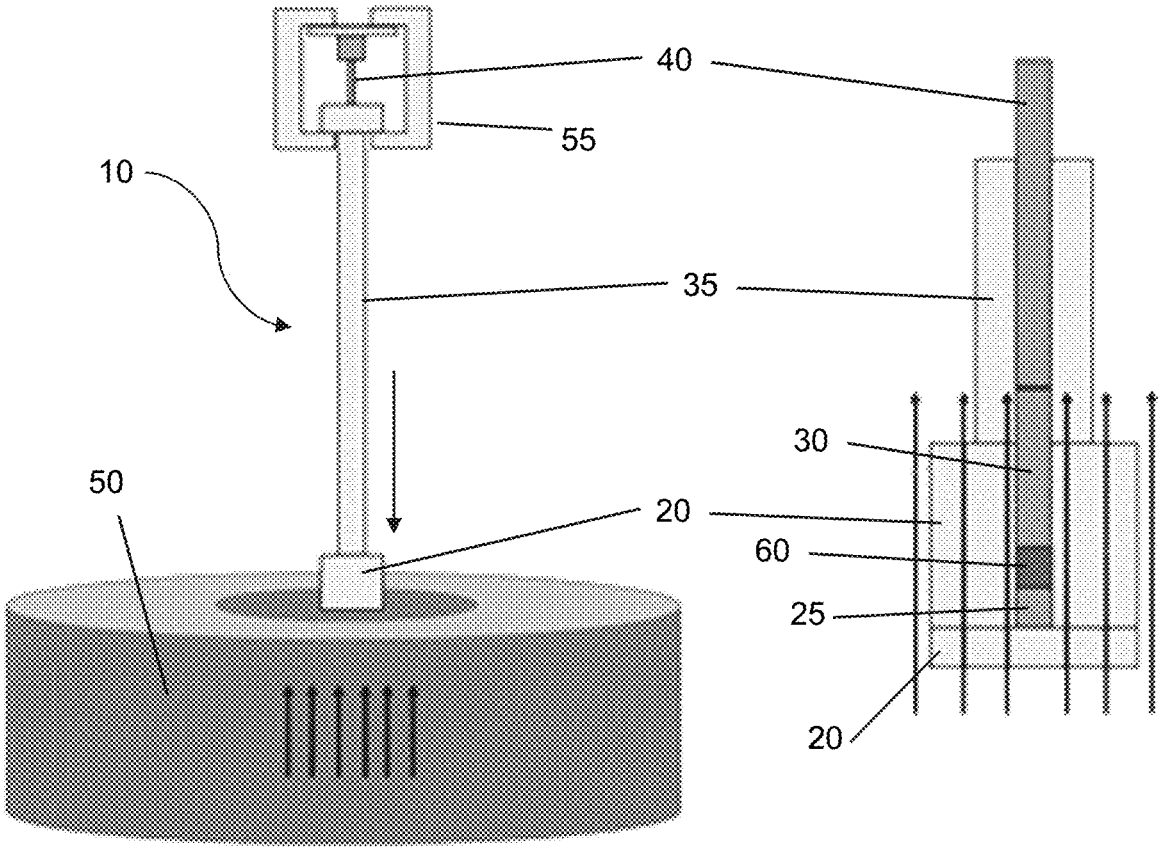
FIG. 8 schematically illustrates the field alignment puck press. Drawing of the magnetic press system (left). The press die is shown just before insertion into the magnet. The die is located at the bottom of a tube with punch extending far above the field region. Load clamps are positioned on the extended die punch at the top to apply up to 500 lbs. of load onto the die punch. Detail drawing of the die press located within the magnetic field (right). The extended punch connects to the powder via the die punch to compress the powder after the magnetic alignment of the particles to the field.

Once assembled the apparatus 10 is loaded into a support frame that holds the system at the desired location. The tubular design facilitates ease of movement into and out of the magnetic field region by sliding the apparatus 10 along the press tube 35. An amount of time is allowed to pass to allow the material to at least partially equilibrate in the non-ambient environment. The pellet is formed by pressing down onto the extended push pin 40 while the material is in the non-ambient environment. This can be achieved using a levered load press or other methods suitable to the user. The mechanism that presses on the extended push pin 40 may be outside of the non-ambient environment or in a weaker form of the non-ambient environment. A plate and bolt configuration may be used to apply the load, which may be, for example, about 1000 pounds. FIG. 8 shows the apparatus 10 in a 3 T superconducting toroid magnet 50. The up arrows indicate the direction of the magnetic field. The load clamp 55 is shown at the top and the die is shown in "cut-away" view with powder 60 loaded. The support frame that holds the apparatus in place is not shown. The down arrow indicates lowering of the die into the magnet 50.

In one example, a 30 kG superconducting toroid magnet was used that generates an axial field along the direction of the puck press load. BaM powder was purchased from Trans-Tech, Inc., Adamstown, Md., US with a specified average particle size of 0.5 μm. The BaM powder was sieved to obtain agglomerate sizes of 53 μm or less and mixed with a polyvinyl alcohol (PVA) binder to facilitate puck compaction. The magnetic press setup is shown in FIG. 8. The magnetic field was generated by a Cryomagnetics 3 T (30 kG) superconducting toroid. The magnet was comprised of two coils in a Helmholtz configuration that are powered by two Cryomagnetics CS-4 bipolar power supplies so that a uniform field is generated within the 8 in long 3 in diameter bore of the magnet. The field generated inside the bore was uniform within a 4 in length to within 10% of the center value.

Figure 9:
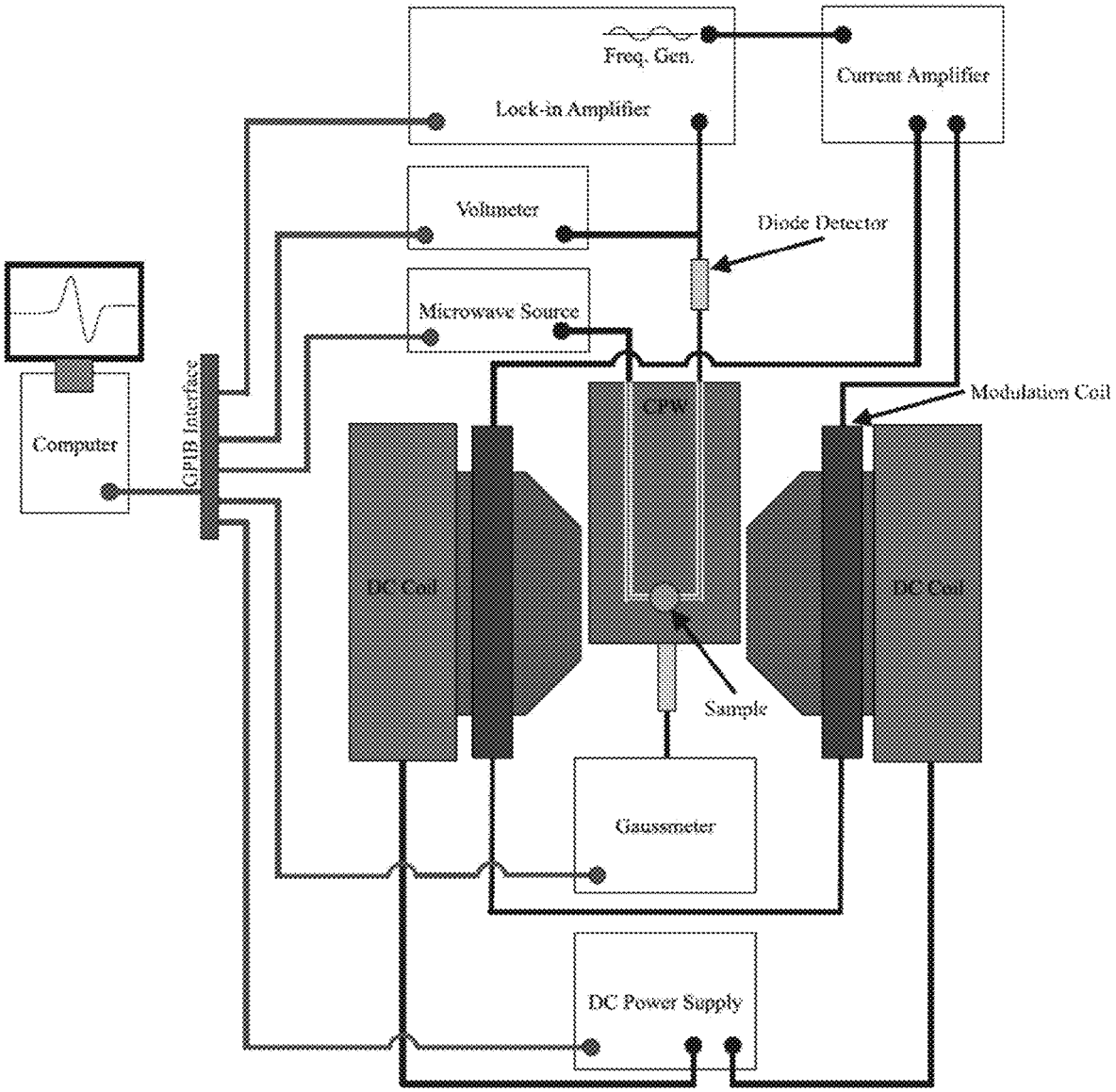
FIG. 9 schematically illustrates the experimental setup for measuring FMR. See text for details. Drawing is not to scale. The CPW test fixture at the center is shown with sample mounted on the IP orientation for clarity.
Figure 10A:
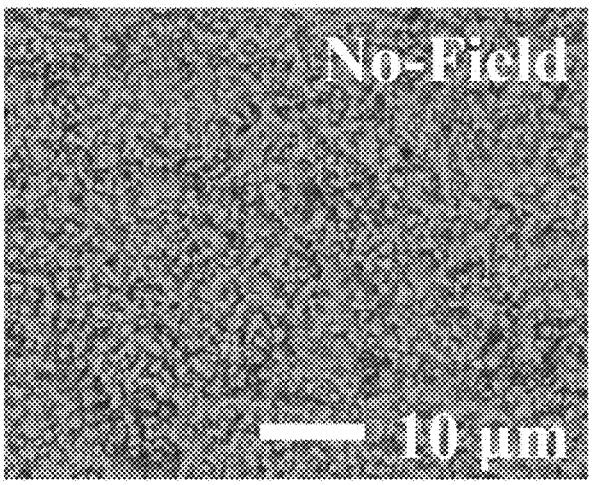
FIGS. 10A-D show SEM images of the surface of no-field formed pucks (FIGS. 10A-B) and 30 kG field formed pucks (FIGS. 10C-D) at two magnifications.
Figure 10B:
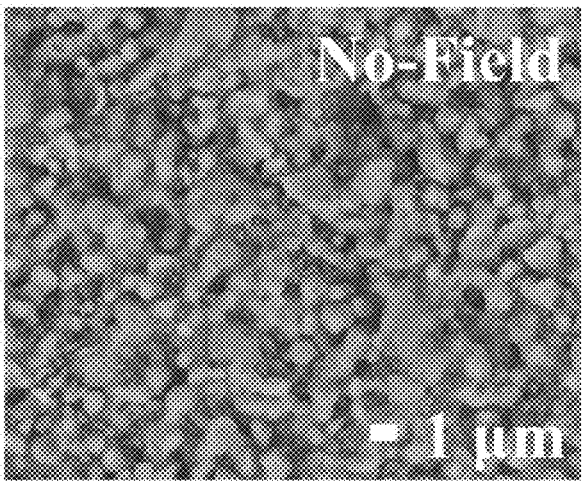
Figure 10C:
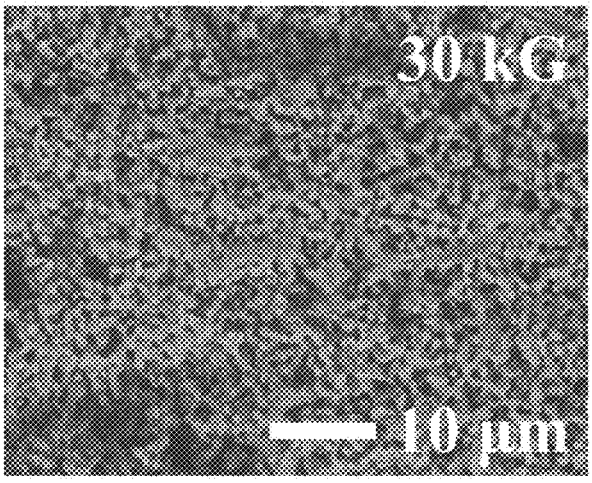
Figure 10D:
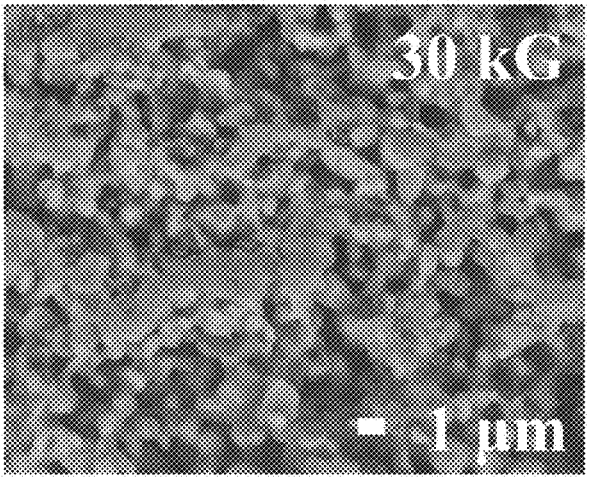

The puck formation was accomplished by using a custom-built press with an affixed die and punch mounted on the end of a tube that is guided into the magnet bore. The entire system was made of non-magnetic stainless steel and aluminum parts. The cross-sectional view of the press is shown on the right side of FIG. 8. The die punch was comprised three parts; the lower section was placed below the powder and rested on the bottom of the die, the second section extended from above the powder to outside the die itself, and the third section contacted the second die section and extended through the extension tube and out to the load clamp. The entire press system was free to slide vertically into and out of the magnet bore to facilitate loading and positioning of the press into the field region. The bottom plate of the die was removable to allow loading and removal of material. A typical procedure for pressing a sample follows: first, prepare powder by sieving and combining with binder as needed. The samples were mixed with PVA binder. Second, insert the lower press punch section into the die. Third, insert a given amount of powder to be pressed. For this example, 0.3 g of powder was used, which resulted in a 6 mm diameter by 3 mm tall puck. Fourth, insert the second punch section into the die and attach it to the extension tube with four socket-head screws. Fifth, mount the entire setup into the slide mechanism that positions the die to the center of the magnet bore and allows vertical movement into and out of the magnet bore. Sixth, energize the magnet to the desired field value. Seventh, slowly lower the press system into the field region and secure it in place. Eighth, activate the load clamp to the desired load and hold it for 5 min. Ninth, remove the press system from the field and detach the press die from the extension tube. Tenth, remove the bottom plate from the die and then remove the sample from the die. The samples were removed from the die and heated in a furnace at 500° C. for 2 h to burn out the binder then sintered at 1200° C. for 2 h in air and thinned to less than about 0.3 mm using 1200 grit sandpaper. SEM was performed using a JEOL JSM-7001F (JEOL Ltd., Tokyo, Japan) in low vacuum mode. The images were taken using a backscatter detector at 20 keV acceleration voltage. The variable pressure capability of the SEM allowed imaging of non-conductive sample without conductive coating on the surface. Crystallographic data were acquired using a Rigaku SmartLab X-ray Diffractometer with a Cu $K_a$ wavelength of 1.540593 Å. Crystallographic texturing was determined by Reitveld refinement using Jade 9 Software. Magnetic hysteresis curves were taken with a MicroSense vibrating sample magnetometer with a 2-T GMW model 3473-70 magnet. Magnetization was calculated using the sample volume. All VSM data are shown corrected for demagnetization effects. FMR results were obtained in a broadband lock-in amplifier configuration using a custom co-planar waveguide (CPW) connected to a Keysight 67 GHz variable frequency source. The CPW is located within a static dc field oriented perpendicular (OOP) to the sample surface. The static dc field is generated by a Lakeshore electromagnet capable of reaching 21 kG. The dc field is modulated by a 40 G ac Helmholtz coil at 47 Hz using a Standford Research Systems 460 lock-in amplifier and bipolar current amplifier. The lock-in amplifier is connected to the output of the CPW to measure the magnitude of the derivative of the absorption of the sample as the dc field is swept at a fixed frequency. This experimental setup is shown in FIG. 9 and is similar to that described in the literature (Kalarickal et al., "Ferromagnetic resonance linewidth in metallic thin films: Comparison of measurement methods" *J. Appl. Phys.,* 99(9), 093909 (2006); Castel et al., "Broadband ferromagnetic resonance measurements in Ni/ZnO and Niγ-$Fe_2O_3$ nanocomposites" *J. Nanomater.,* 2007, 27437 (2007)).

FIGS. 10A-D show SEM images of pucks produced under no-field conditions (FIGS. 10A and B) and under a 30 kG field (FIGS. 3C and D) at two magnifications. The images were taken after lapping the samples using 1200 grit sandpaper and some surface abrasion is visible in the images as flattened regions around the grains. The images show that the pucks are formed of grains less than about 1 μm in size, which is close to the 0.5 μm starting particle size of the powder. The sintering treatment has resulted in some grain necking as seen in the higher magnification images in FIGS. 10B and D, but no grain growth is evident. The surfaces of the pucks also appear porous in the SEM images. The Archimedes density technique was used for the density measurement on the pucks and found that the no-field pucks had a density of about 69% of theoretical (5.28 g/cm3) density and the 30 kG field formed pucks had a density of about 78% of theoretical density.

Figure 11:
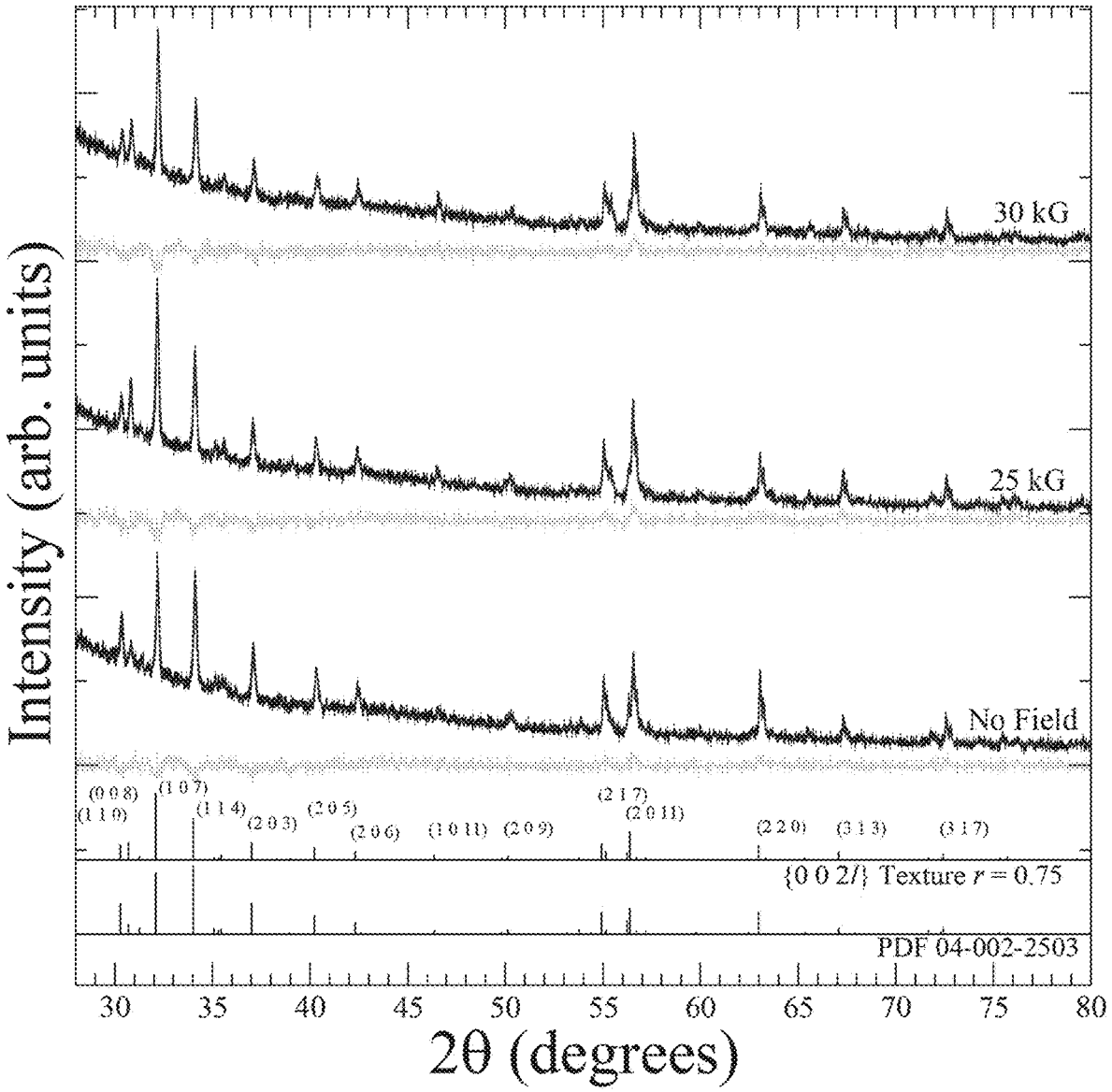
FIG. 11 shows XRD intensity spectra for samples formed under no field, 25 kG, and 30 kG field conditions stacked from bottom to top, respectively, shown in dark with Reitveld refinement fit superimposed. The light data are the residual of the data to the fit. The bottom points are from PDF phase card #04-002-2503 for barium iron oxide (at the bottom) and generated points assuming a March-Dollase factor r=0.75 textured along the {0 0 21} diffraction plane. Selected prominent peaks are indexed.

FIG. 11 shows the stacked XRD spectrum in dark lines for each sample with the powder diffraction file (PDF) phase card #04-002-2503 for barium iron oxide shown at the bottom. Just above the phase card, is shown a generated textured phase card made by assuming a March-Dollase factor of r=0.75 (r=1 being completely random and r=0 being perfectly aligned) with texturing along the {0 0 21} diffraction planes. Reitveld refined curves overlaid on the data. The whole pattern Reitveld refinement was performed for each spectrum using the powder diffraction phase card, as well as, using the March-Dollase method (Dollase, "Correction of intensities for preferred orientation in powder diffractometry: Application of the March model" *J. Appl. Crystallogr.,* 19(4), 267-272 (1986); Harsha et al., "Substrate independence of THz vibrational modes of polycrystalline thin films of molecular solids in waveguide THz-TDS" *J. Appl. Phys.,* 111(2), 023105 (2012)) for determining crystallographic texturing. It was found that the best fits to the no-field data result in an r=0.92 with a fit agreement factor of R %=5.64%. Fitting the data with no texturing assumption results in only a marginally poorer agreement, R %=5.81%. For the 25 and 30 kG formed puck data, the best fit agreement occurs when texturing along {0 0 21} is present. For these samples, r=0.75 (R %=5.90%) and r=0.73 (R %=5.62%) for the 25 and 30 kG, respectively. The difference between the field formed data and no-field formed pucks is evident in the relative heights of several prominent peaks. For example, starting at the lowest diffraction angles, the (1 1 0) is higher intensity than (0 0 8) for the random polycrystalline, but the (1 1 0) is reduced to lower intensity than the slightly increased (0 0 8) when the appropriate degree of texturing is added (r=0.75), which matches to the XRD pattern of the samples made under magnetic field. Similarly, the (1 1 4) peak is more intense than the (1 0 7) peak in the powder diffraction card, but the opposite is true when texturing is applied as seen in the magnetic field formed puck data and textured phase card. It is also evident that the (2 0 3) peak is slightly diminished in intensity and the (2 0 11) peak is increased in intensity in the samples formed in a magnetic field and the textured phase card compared to the polycrystalline phase card. To better quantify the March-Dollase factor, it has been suggested that the percentage of oriented grains in the film can be related to the March-Dollase factor (Zolotoyabko, "Determination of the degree of preferred orientation within the March-Dollase approach" *J. Appl. Crystallo.,* 42(3), 513-518 (2009)) as $$\eta = 100\% \sqrt{\frac{(1-r)^3}{(1-r^3)}}. \quad \text{Eq. (1)}$$

Using the r values stated above, the percentage of oriented grains for the samples was obtained: no-field η=5%, 25 kG field η=16%, and 30 kG field η=18%.

Figure 12:
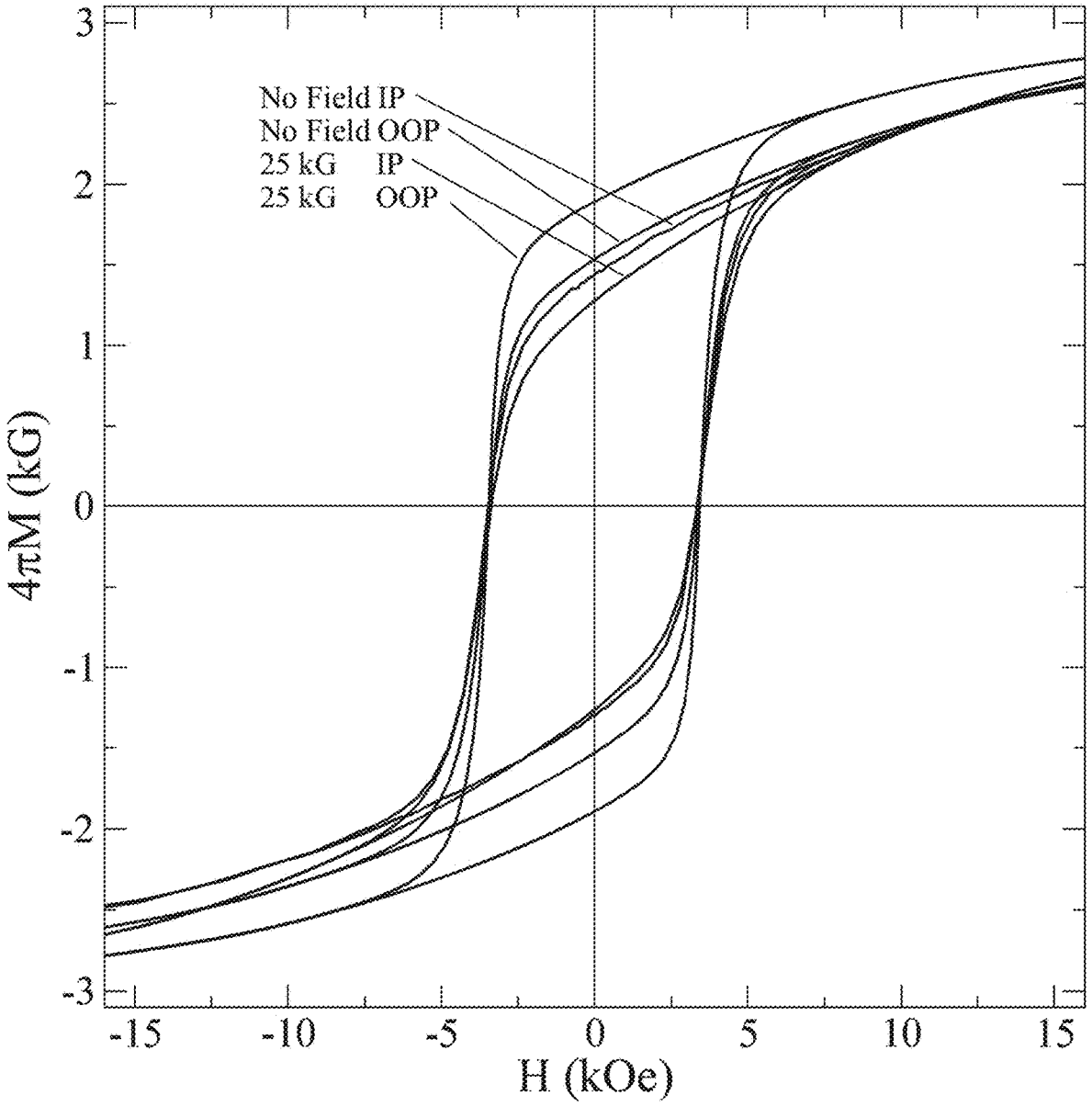
FIG. 12 shows a plot of magnetic hysteresis measured IP and OOP for pucks formed under no-field condition and under a 25 kG applied field.

FIG. 12 shows a plot of the magnetic hysteresis curves for samples measured in-plane (IP) and OOP under no-field condition and under a 25 kG applied field. The 25 and 30 kG formed samples show identically overlapping hysteresis curves and so only the 25 kG data are shown for clarity. Upon inspection of the no-field formed sample, very little difference is seen between the IP and OOP measurements indicating that the sample is comprised of randomly oriented grains with no preferential orientation. The samples do not reach full magnetic saturation 4π $M_s$, however, in the OOP orientation, the sample can be seen to approach closely to 4πMs. For clarity, the value of magnetization at the highest field measured (15 kOe) is referred to as the value of maximum magnetization 4π $M_{max}$. It can be seen in FIG. 5 that 4π $M_{max}$ is approaching close to saturation but will saturate below 3 kG. For these samples, 4π $M_{max}$=2.7 kG with a coercivity of $H_c$=3.4 kOe. This value of 4π $M_{max}$ is considerably less than the expected value of magnetic saturation 4π Ms=4.8 kG for BaM, but the value of $H_c$ is appreciable to the value of about 4 kOe generally reported for this material. The squareness, defined herein as $SQ=M_r/M_{max}=0.5$ for both IP and OOP measurements of the no-field sample also indicates a randomly oriented material. If the ratio of IP magnetic remanence to the OOP magnetic remanence $M_r^{para}/M_r^{perp}$ is taken as a gauge of magnetic texturing with 1 being completely randomly oriented and 0 being highly textured, a value of 1.0 is obtained for these samples.

Inspecting the samples formed in the magnetic field, as shown in FIG. 12, it is clear that $H_c$ is the same as the no-field formed samples, but $4\pi M_{max}=2.8$ kG (measured OOP) is a slight increase over the no-field pressed samples. The samples formed with field show SQ=0.6 for the OOP orientation indicating only a slight amount of orientation by this measure. However, employing the magnetic texture value for the 25 kG samples $M_r^{para}/M_r^{perp}=0.77$, indicating a clear texturing in these samples due to the influence of the magnetic field during pressing. The magnetic properties of these samples are summarized in Table I, showing values for maximum magnetization $4\pi M_{max}$, squareness $SQ=M_r/M_{max}$, and coercive field $H_c$, for pucks formed under no field, 25 kG field, and 30 kG field conditions. Data are for samples measured OOP.

TABLE I

Measured values for saturation magnetization ($4\pi M_{max}$), squareness ($SQ = M_r/M_{max}$), magnetic texture ($M_r^{para}/M_r^{perp}$), and coercive field ($H_c$), for pucks formed under no-field, 25 kg field, and 30 kg field conditions. Except for the magnetic texture values, all data are measured OOP.

| Press field (kG) | $4\pi M_{max}$ (kG) | SQ | $M_r^{para}/M_r^{perp}$ | $H_c$ (kOe) |
|---|---|---|---|---|
| No-field | 2.6 | 0.52 | 1.0 | 3.42 |
| 25 | 2.8 | 0.61 | 0.77 | 3.45 |
| 30 | 2.8 | 0.62 | 0.74 | 3.42 |

Figure 13:
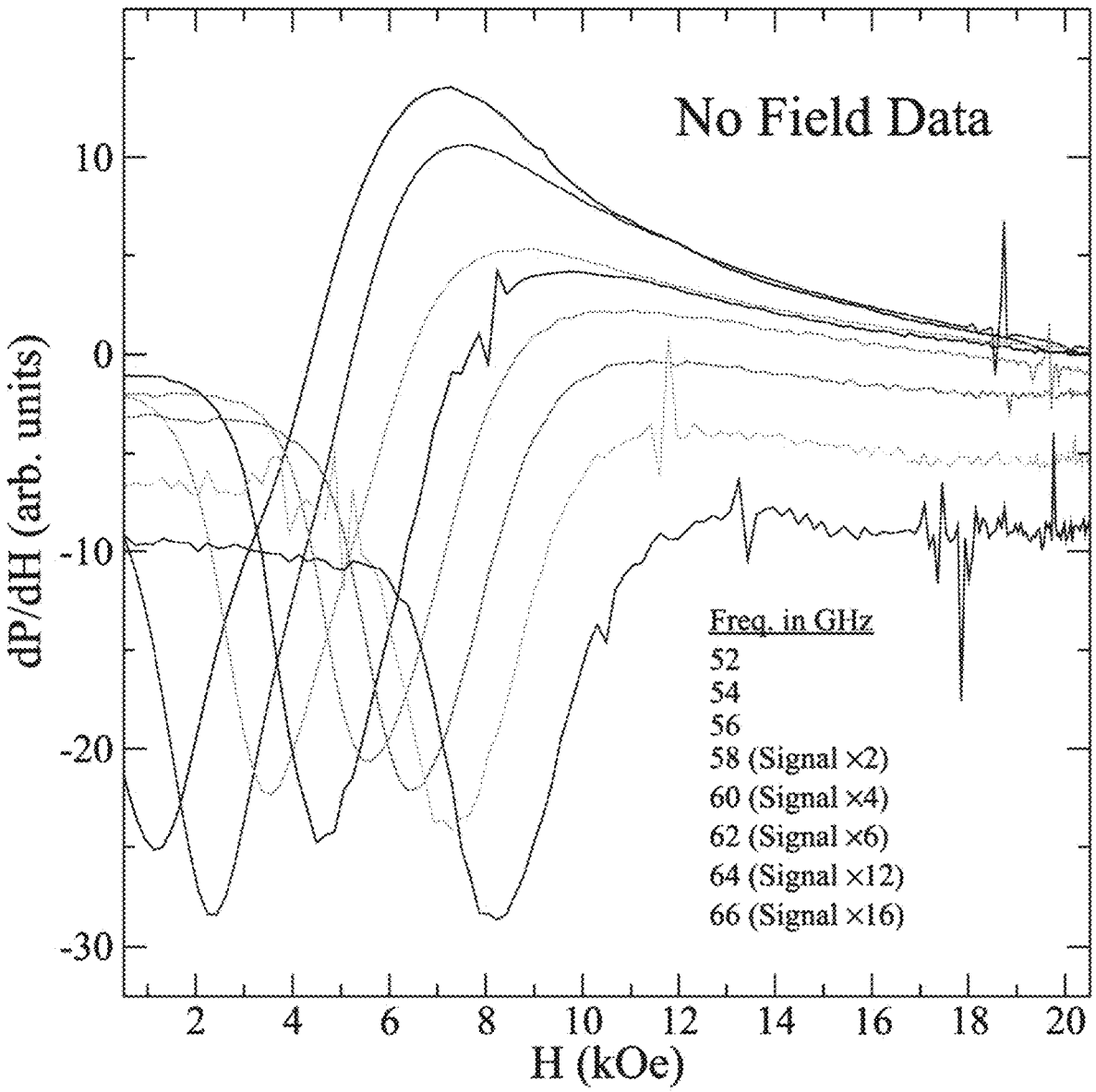
FIG. 13 shows a plot of absorption derivative signal for a sample formed with no field for various frequencies between 52 and 66 GHz. Signal scaling was used on the data after acquisition due to increased loss in the CPW test fixture. The listed frequencies are in the same order as the curves from top to bottom at 9 kOe.
Figure 14:
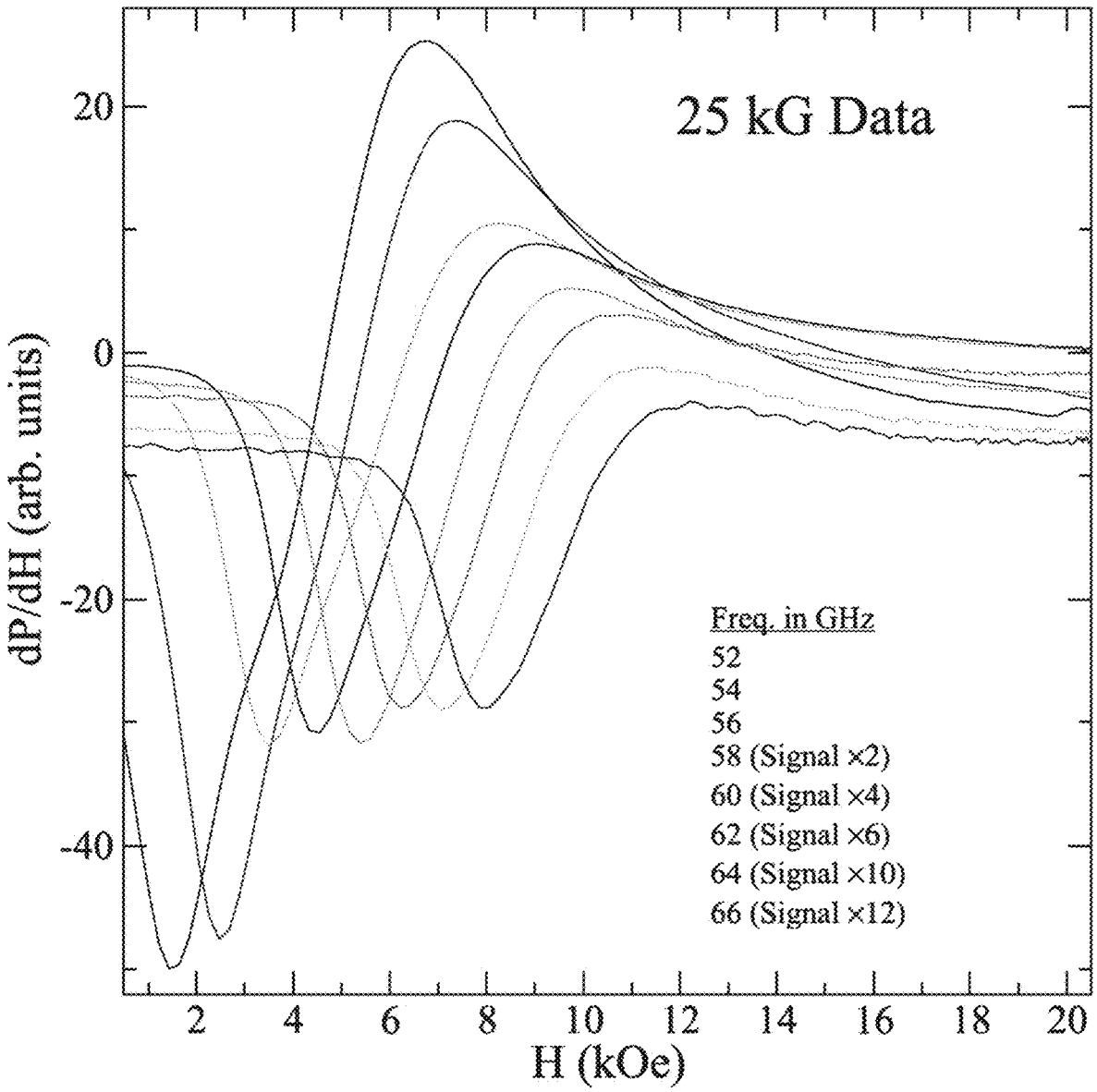
FIG. 14 shows a plot of absorption derivative signal for a sample formed with 25 kG applied field for various frequencies between 52 and 66 GHz. Signal scaling was used on the data after acquisition due to increased loss in the test fixture. The listed frequencies are in the same order as the curves from top to bottom at 9 kOe.
Figure 15:
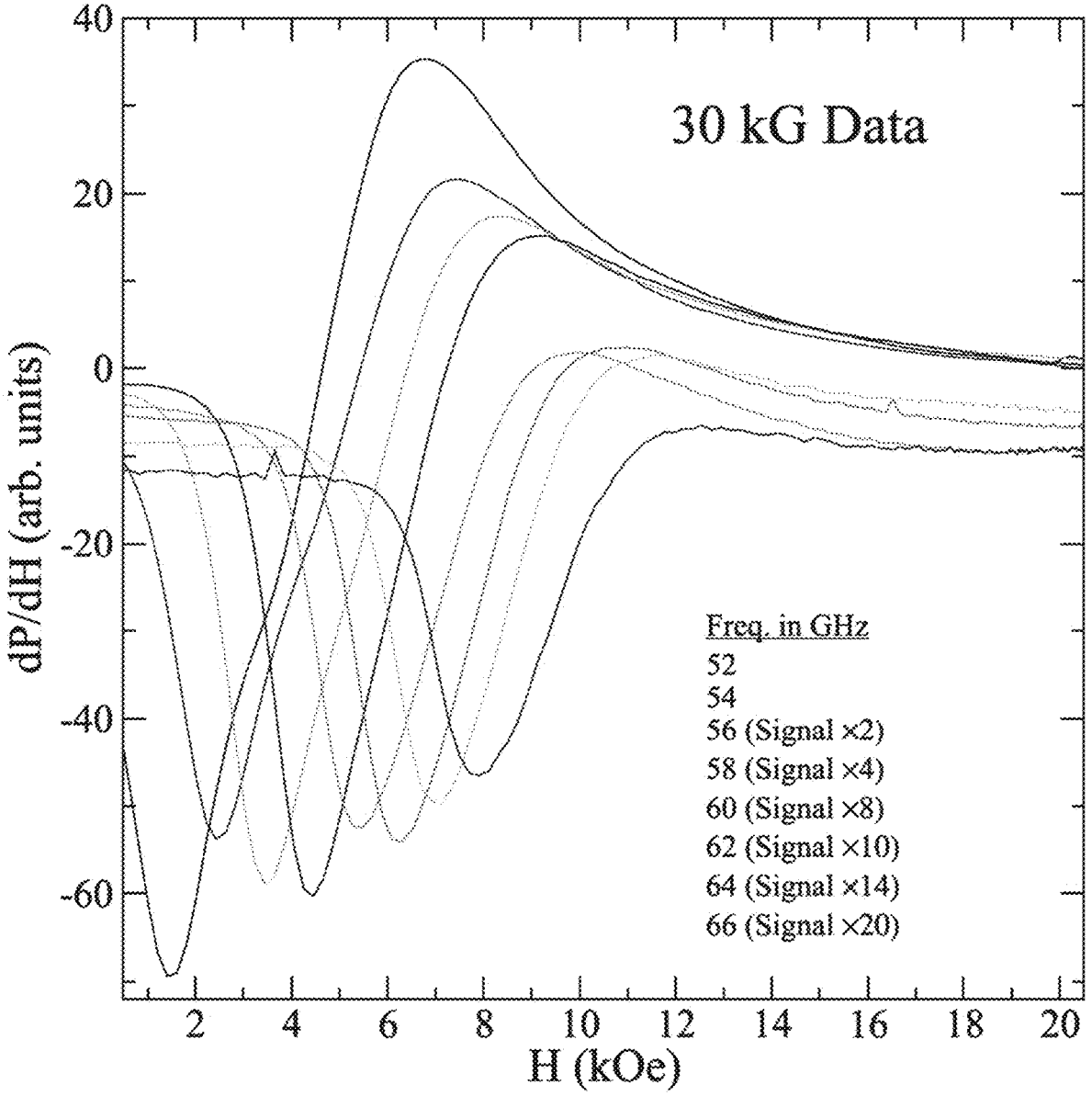
FIG. 15 shows a plot of absorption derivative signal for a sample formed with 30 kG applied field for various frequencies between 52 and 66 GHz. Signal scaling was used on the data after acquisition due to increased loss in the test fixture. The listed frequencies are in the same order as the curves from top to bottom at 9 kOe.

FIG. 13 shows derivative absorption data taken between 52 and 66 GHz. (The listed frequencies in FIGS. 13-15 are in the same order as the curves from top to bottom at 9 kOe.) Data taken below 52 GHz did not show a complete curve and so were not included. The data show a strong absorption response from the sample with an asymmetric line shape, likely due to multiple modes present in the sample. As the frequency is increased, the overall signal decreases due to increased loss in the CPW fixture. As can be seen in the data, the resonance center moves up in field with increasing frequency.

FIGS. 14 and 15 show derivative absorption data taken between 52 and 66 GHz for sample formed under a 25 kG field and 30 kG field, respectively. Data taken below 52 GHz did not show a complete curve and so were not included. These data are similar to the no-field sample shown in FIG. 13 except a stronger signal is present as indicated by the larger overall magnitude of the signal and less noise in the data. These data also show an asymmetric line shape, likely due to multiple modes present in the sample.

The manner in which the resonance field moves with frequency is consistent with the Kittel relation for OOP orientation $$f_r=\gamma(H_r+H_k+4\pi M_s) \quad \text{Eq. (2)}$$

where γ is the gyromagnetic ratio, $H_r$ is the resonance field, $H_k$ is the crystalline anisotropy field, and $f_r$ is the resonance frequency. Table II summarizes selected $f_r$ values and the corresponding resonance field $H_r$ values along with the measured FMR linewidth ΔH and the extrapolated zero-field FMR point.

TABLE II

Measured values of resonance field ($H_r$) and linewidth (ΔH). Values of anisotropy field ($H_k$), gyromagnetic ratio (γ), and zero-field FMR are extracted from Eq. (2). All units are in kOe unless otherwise specified. Data are for samples measured OOP.

| Press field | $f_r$ = 54 GHz | | $f_r$ = 60 GHz | | $f_r$ = 64 GHz | | | γ | Zero-field FMR |
|---|---|---|---|---|---|---|---|---|---|
| (kG) | $H_r$ | ΔH | $H_r$ | ΔH | $H_r$ | ΔH | $H_k$ | (GHz/kOe) | (GHz) |
| No-field | 4.95 | 5.1 | 7.85 | 4.5 | 9.40 | 4.0 | 22 | 2.2 | 43 |
| 25 | 4.55 | 6.1 | 7.60 | 4.4 | 9.20 | 4.2 | 22 | 2.3 | 43 |
| 30 | 4.95 | 4.9 | 7.55 | 4.1 | 9.15 | 4.1 | 21 | 2.4 | 42 |

Figure 16:
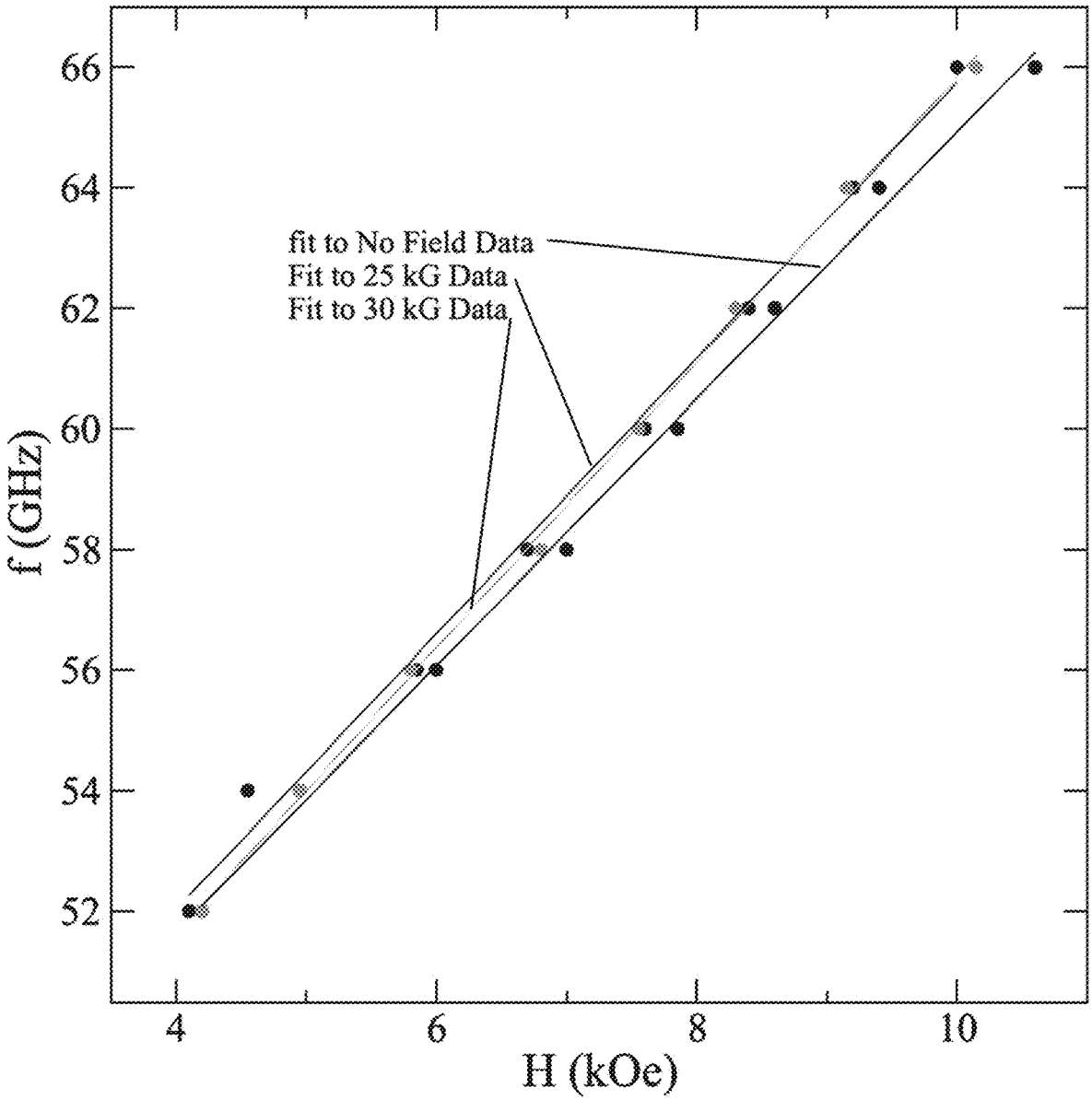
FIG. 16 shows a plot of resonance frequency versus resonance field measured from the curves in FIGS. 13-15 with Eq. (2) fit to the data.

FIG. 16 shows a plot of the resonance frequency versus applied field for each of the samples presented. As can be seen in the figure, the data fall very close to each other giving rise to values of γ and $H_k$ derived from the fit to Eq. (2) that are very similar.

The XRD and VSM data presented both indicate texturing in these materials when a field is applied to the pucks during compaction. The evidence is found both in the good fit using the March-Dollase factor as well as the increased ratio of IP to OOP remanence found using the VSM. It may be of interest to note the similarities between the VSM parameters $M_r^{para}/M_r^{perp}$ shown in Table I and the March-Dollase factor. For the 25 kG sample, we find r=0.75 and $M_r^{para}/M_r^{perp}=0.77$ and for the 30 kG sample r=0.73 and $M_r^{para}/M_r^{prep}=0.74$. In other samples showing preferred orientation (Johnson et al., "Formation of magnetically-oriented barium hexaferrite films by aerosol deposition" *J. Magn. Magn. Mater.,* 479, 156-160 (2019)), agreement is also found between $M_r^{para}/M_r^{perp}$ r and the March-Dollase r-factor.

The fact that the texturing does not increase significantly between the 25 and 30 kG field suggests that the operation was above the limit where the field strength can further move the particles into alignment. For improving the texturing further additional measures must be explored. One possible route to increasing the particle movement is by suspending the particles in solution inside the press die. The press may then be heated during compaction to evaporate the fluid and allow particle compaction. Another route to improved sample properties is to increase the load of the press. The current setup has been fit with a low-load fixture. The low-load value may be a reason for the low density of the samples and the low value of $4\pi M_{max}$. If the density values are taken in to account by scaling $4\pi M_{max}$ by the measured density to account for the non-magnetic pores, the value of $4\pi M_{max}=3.8$ kG and $4\pi M_{max}=3.5$ kG for the no-field and 30 kG formed samples respectively. These values start to approach the expected value for BaM of $4\pi M_s$=4.8 kG. The $4\pi M_{max}$ value of these samples may be further improved by increasing the grain size through increased sintering temperature. The smallness of the grains seen in the SEM images is also consistent with the large value of $H_c$. Since grains size has been found to be inversely proportional to $H_c$ (Dho et al., "Effects on the grain boundary of the coercivity of barium ferrite $BaFe_{12}O_{19}$" *J. Magn. Magn. Mater.,* 285(1-2), 164-168 (2005); Johnson et al., "Magnetic and structural properties of sintered bulk pucks and aerosol deposited films of Ti-doped barium hexaferrite for microwave absorption applications" *J. Appl. Phys.,* 122 (2), 024901 (2017), improved $4\pi M_{max}$ might be expected but at the expense of decreasing $H_c$. The FMR results suggest that the effects of porosity and the majority of randomly oriented grains may be more influential than the minority percentage of aligned grains in these samples. Apart from the overall improved signal, the characteristics of these samples do not show any marked difference in the FMR curves. The influence of the magnetic field during pressing was found to have a significant improvement on the magnetic properties.

Obviously, many modifications and variations are possible in light of the above teachings. It is therefore to be understood that the claimed subject matter may be practiced otherwise than as specifically described. Any reference to claim elements in the singular, e.g., using the articles "a", "an", "the", or "said" is not construed as limiting the element to the singular.

What is claimed is:

1. A method comprising:

providing an apparatus comprising:

a die body having a first cylindrical hole therethrough;

a die bottom attached to the die body to cover a first opening of the first hole;

a cylindrical short push pin shorter than the first hole and having the same cross-section as the first hole inserted into the first hole;

a long push pin having a first cylindrical end having the same cross-section as the first hole and a second end having a smaller cross-section than the first end;

an O-ring around the second end;

a press tube having a second hole therethrough attachable to the die body to align the second hole with a second opening of the first hole; and an extended push pin that fits through the second hole;

wherein the combined length of the short push pin, the long push pin, and the extended push pin is longer than the combined length of the first hole and the second hole;

placing a material into the first hole;

placing the first end of the long push pin into the first hole leaving a space between the material and the long push pin;

attaching the press tube to the die body;

placing the extended push pin in the second hole;

positioning the apparatus to place the material in a non-ambient environment;

allowing the material to at least partially equilibrate in the non-ambient environment; and pressing on the extended push pin to form a pellet of the material while the material is in the non-ambient environment.

2. The method of claim 1, wherein the non-ambient environment is a magnetic field.

3. The method of claim 2, wherein the magnetic field is at least 1 T.

4. The method of claim 2, wherein the material is barium hexaferrite.

5. The method of claim 2, wherein the apparatus is non-magnetic.

6. The method of claim 1, wherein the non-ambient environment is a magnetic field, a vacuum, an elevated temperature, an electric field, or any combination thereof.

7. The method of claim 1, wherein the pressing on the extended push pin is outside of the non-ambient environment.

8. An apparatus comprising:

a die body having a first cylindrical hole therethrough;

a die bottom attached to the die body to cover a first opening of the first hole;

a cylindrical short push pin shorter than the first hole and having the same cross-section as the first hole inserted into the first hole;

a long push pin having a first cylindrical end having the same cross-section as the first hole inserted into the first hole and a second end having a smaller cross-section than the first end;

wherein the short push pin is between the die bottom and the first end of the long push pin;

an O-ring around the second end;

a press tube having a second hole therethrough attached to the die body to align the second hole with a second opening of the first hole; and an extended push pin inserted into the second hole;

wherein the combined length of the short push pin, the long push pin, and the extended push pin is longer than the combined length of the first hole and the second hole.

9. The apparatus of claim 8, wherein the apparatus is non-magnetic.

* * * * *